US007021671B2

(12) United States Patent
Evans

(10) Patent No.: US 7,021,671 B2
(45) Date of Patent: Apr. 4, 2006

(54) SEPTIC TANK DRAIN FIELD PIPE MANIFOLD SYSTEM AND METHOD OF USE

(75) Inventor: Kelvin Todd Evans, Orange City, FL (US)

(73) Assignee: Dixie Septic, Inc. of Orange City, Orange City, FL (US)

( * ) Notice: Subject to any disclaimer, the term of this patent is extended or adjusted under 35 U.S.C. 154(b) by 0 days.

(21) Appl. No.: 10/620,283

(22) Filed: Jul. 15, 2003

(65) Prior Publication Data

US 2004/0065364 A1 Apr. 8, 2004

Related U.S. Application Data

(60) Provisional application No. 60/395,817, filed on Jul. 15, 2002.

(51) Int. Cl.
*F16L 39/00* (2006.01)
*E02B 13/00* (2006.01)
*E02B 11/00* (2006.01)

(52) U.S. Cl. ..... 285/125.1; 285/129.1; 285/133.3; 405/36; 405/43; 405/47; 405/51; 137/561 A

(58) Field of Classification Search ..... 285/125.1, 285/129.1, 129.2, 130.1, 133.3; 405/36, 405/43, 47, 49, 51; 137/561 A, 236.1; 210/532.2
See application file for complete search history.

(56) References Cited

U.S. PATENT DOCUMENTS 1,484,575 A 2/1924 Shulin
1,718,450 A * 6/1929 Backus ..... 285/125.1
1,795,123 A * 3/1931 Harris ..... 137/236.1
2,518,620 A * 8/1950 Hughes ..... 210/239
2,536,196 A * 1/1951 MacLeod ..... 405/43
2,680,632 A * 6/1954 Spieth ..... 285/130.1
3,200,539 A 8/1965 Kelly
3,551,007 A 12/1970 Martin et al.
3,695,643 A 10/1972 Schmunk
3,825,288 A 7/1974 Maroschak
3,873,391 A 3/1975 Plauka et al.
D235,103 S 5/1975 Maroschak et al.
4,174,067 A 11/1979 Watanabe et al.
4,180,348 A * 12/1979 Taylor ..... 405/39
4,286,808 A 9/1981 Fouss et al.
4,353,859 A 10/1982 Palmer
4,536,104 A * 8/1985 Bungert ..... 406/183
4,605,501 A * 8/1986 Tyson ..... 210/519
4,614,584 A * 9/1986 Di Duca ..... 210/422
4,756,827 A * 7/1988 Mayer ..... 405/40
4,998,754 A * 3/1991 Matsumoto et al. ..... 285/125.1
5,039,251 A * 8/1991 Schlueter et al. ..... 405/39
5,098,568 A * 3/1992 Tyson ..... 210/519
5,127,551 A * 7/1992 Black et al. ..... 222/129.1
5,176,177 A * 1/1993 Rupp ..... 137/883
D348,511 S 7/1994 Denton (Continued)

*Primary Examiner*—James M. Hewitt
(74) *Attorney, Agent, or Firm*—Allen, Dyer, Doppelt, Milbrath & Gilchrist, P.A.

(57) ABSTRACT

A manifold having a tubular body including effluent retention areas formed within the body and conduit portions having opposing ribs extending radially from an outside surface for use with a pipe anchoring mechanism when installing the manifold and connected flexible corrugated pipe within a septic tank drain field. The manifold includes longitudinally opposing input and output ports for connection to a cooperating manifold or pipe. Multiple transverse ports provide connection from the manifold to an effluent source such as a septic tank or drain field distribution pipe.

28 Claims, 7 Drawing Sheets

U.S. PATENT DOCUMENTS 5,444,879 A * 8/1995 Holtsnider ..... 4/541.1
5,549,415 A 8/1996 Evans
5,597,264 A * 1/1997 Laak ..... 405/36
5,680,989 A * 10/1997 Plachy et al. ..... 239/193
5,829,916 A 11/1998 Evans
5,950,575 A * 9/1999 Simons et al. ..... 122/511
D416,074 S 11/1999 Mogg
5,984,574 A * 11/1999 Sinclair ..... 405/43
5,988,943 A * 11/1999 McCord ..... 405/36
5,998,754 A * 12/1999 Pervieux ..... 209/587
6,120,209 A 9/2000 Evans
6,503,392 B1 * 1/2003 Tyson ..... 210/170
2003/0192598 A1 * 10/2003 Hobson et al. ..... 137/561 A

* cited by examiner

SEPTIC TANK DRAIN FIELD PIPE MANIFOLD SYSTEM AND METHOD OF USE

CROSS-REFERENCE TO RELATED APPLICATIONS

This application claims the benefit of U.S. Provisional Application No. 60/395,817, filed Jul. 15, 2002 for Septic Tank Drain Field Manifold System and Method of Use, the disclosure of which is incorporated herein by reference in its entirety.

FIELD OF THE INVENTION

This invention relates to septic tank drain fields and, more particularly, to a multi port manifold pipe for providing equal distribution of septic tank effluent to all connecting pipes within the drain field.

BACKGROUND OF THE INVENTION

Septic tank drain fields generally comprise a network of trenches dug on suitable land adjacent the septic tank. Distribution pipes are placed into these trenches and connected to the septic tank for receiving effluent therefrom. These distribution pipes are preferably joined together by pipe manifolds that aid in distribution of the effluent to a plurality of distribution pipes. The skilled will appreciate that in laying out such a network of effluent distribution pipes, it is necessary to ensure proper alignment of the network lies within a calculated horizontal range so as to ensure even flow of the effluent from the septic tank to final discharge points. In addition, it would be preferable to include structural features in the distribution pipes, pipe manifolds that would aid in the even distribution of effluent throughout the drainpipe system.

SUMMARY OF THE INVENTION

With the foregoing in mind, an embodiment of the present invention provides a multi port manifold for distribution of septic tank effluent in a drain field. The manifold may comprise an elongate tubular body having a first longitudinal port and an opposing second longitudinal port for providing fluid flow through the body along its longitudinal axis. The elongate tubular body may include at least one effluent retention portion and at least one conduit portion, wherein the conduit portion has a girth less that of the retention portion. One embodiment of the manifold may include a first transverse port positioned between the first and second longitudinal ports for providing a transverse fluid flow from the first retention portion of the effluent retention portion. The first transverse port may have an axis within a plane of and generally orthogonal to the longitudinal axis. A second transverse port may be positioned between the first transverse port and the first and second longitudinal ports for providing a second transverse fluid flow from a second retention portion. The second transverse port may have an axis within the plane of and generally orthogonal to the longitudinal axis. Opposing first and second ribs extend outwardly from an outside surface of the conduit portion of the tubular body. The first and second ribs may radially extend from the longitudinal axis and may be orthogonal to the plane having the transverse port axes and longitudinal axis.

A method aspect of the invention may include connecting multiple manifolds for providing a drain field effluent retention and distribution system. The transverse ports may be arranged for providing a uniform alignment of drain field distribution pipe using a single manifold construction while connection multiple manifolds in a right side up and up side down arrangement for achieving a desired distribution.

The manifold may include structural features for the manifold to hold approximately 1½ of fluid at all times, to thereby aid in equal distribution of effluent to all connecting drain field pipes. The ribs allow the manifold to be held in place by a clamp described by way of example in U.S. Pat. No. 6,120,209 for Method of Installing Drain field pipe, the disclosure of which is incorporated herein by reference.

BRIEF DESCRIPTION OF THE DRAWINGS

Embodiments of the invention are described by way of example with reference to the accompanying drawings in which.

DETAILED DESCRIPTION OF THE PREFERRED EMBODIMENTS

The following illustrates the principles, practice, and applications of methods constituting this invention. While this invention is satisfied by embodiments in many different forms, there will herein be described in detail certain embodiments of the invention, with the understanding that the present disclosure is to be considered as exemplary of the principles of the invention and is not intended to limit the invention to the embodiments illustrated and described.

Figure 1:
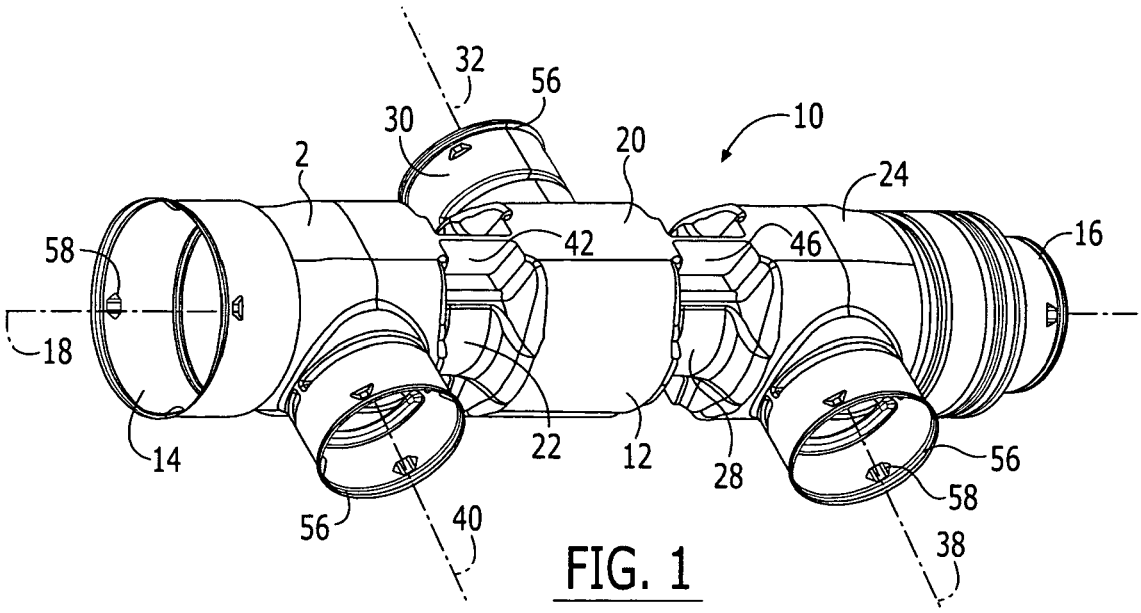
FIG. 1 is a perspective view of one embodiment of the present invention illustrating a manifold having inlet and outlet ports extending along a longitudinal axis and three transverse distribution ports.
Figure 2:
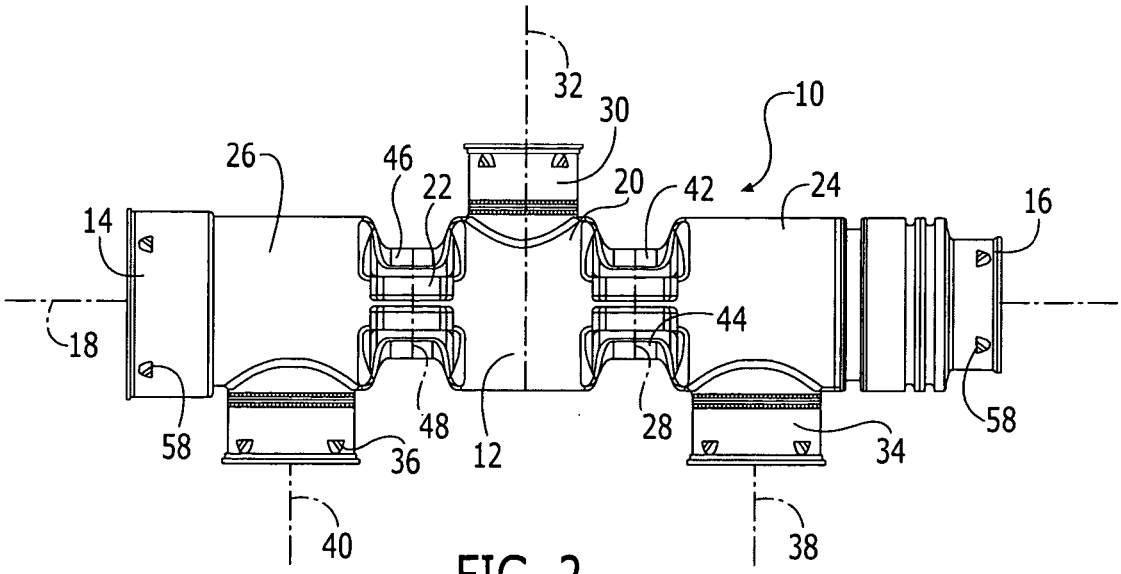
FIG. 2 is a top plan view of the embodiment of FIG. 1.
Figure 3:
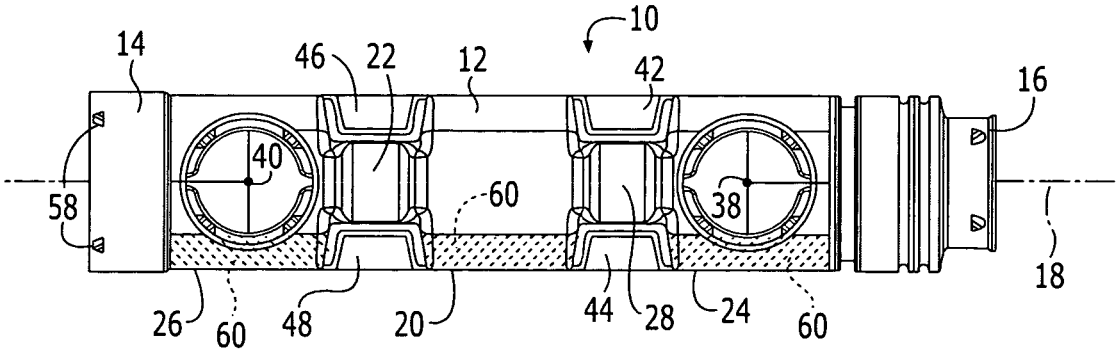
FIG. 3 is a rear elevation view of the embodiment of FIG. 1.

With reference initially to FIGS. 1–3, one embodiment of a manifold 10 includes an elongate tubular body 12 having a first longitudinal port 14 and an opposing second longitudinal port 16 for providing fluid flow through the body along a longitudinal axis 18. The elongate tubular body 12 may include a first effluent retention portion 20 and a first conduit portion 22. As illustrated herein by way of example for a thin walled embodiment herein, the conduit portion 22 has a girth 23 less that of the retention portion 20. For the embodiment herein described by way of example, the manifold 10 also includes second and third retention portions 24, 26, respectively, and a second conduit portion 28. As is apparent to one skilled in the art and as detailed later in this section, an inner cross sectional area of the tubular body 12 for the retention portions 20, 24, 26 is greater than the inner cross section area of the tubular body for the conduit portions 22, 28.

Figure 4:
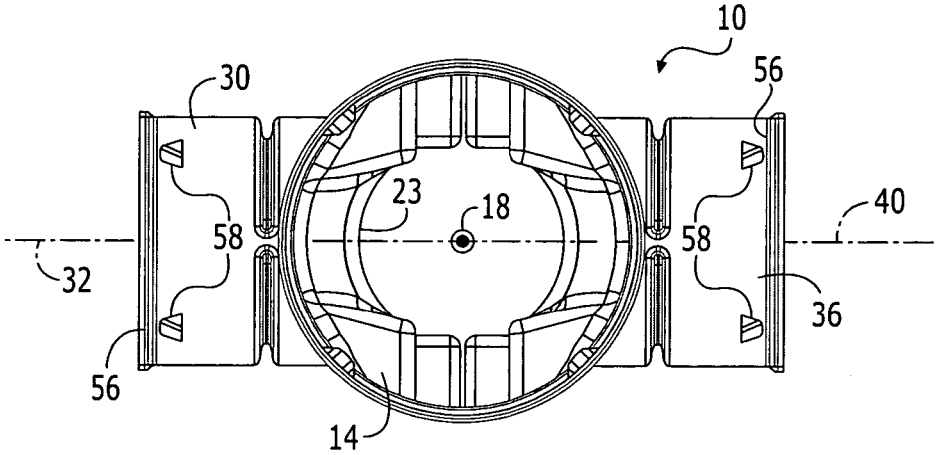
FIG. 4 is a connection (inlet) port elevation end view of the embodiment of FIG. 1.

With continued reference to FIGS. 1–3 and to FIG. 4, a first transverse port 30 is positioned between the first and second longitudinal ports 14, 16 for providing a transverse fluid flow from the first effluent retention portion 20. The first transverse port 30 has an axis 32 within a plane of and generally orthogonal to the longitudinal axis 18. As herein described by way of example for the embodiment described, second and third transverse ports 34, 36, respectively are positioned between the first transverse port 30 and the first and second longitudinal ports 14, 16 for providing an alternate transverse fluid flow from the second and third retention portions 24, 26, the second and third transverse ports 34, 36 having axes 38, 40 respectively within the plane of and generally orthogonal to the longitudinal axis 18.

With reference again to FIGS. 1–3, opposing first and second ribs 42, 44 and third and fourth opposing ribs 46, 48 extend radially outwardly from an outside surface of the conduit portions 22, 28 of the tubular body 12. The ribs 42–44 are orthogonal to the plane having the transverse port axes 32, 38, 40 and longitudinal axis 18 therein.

Figure 5:
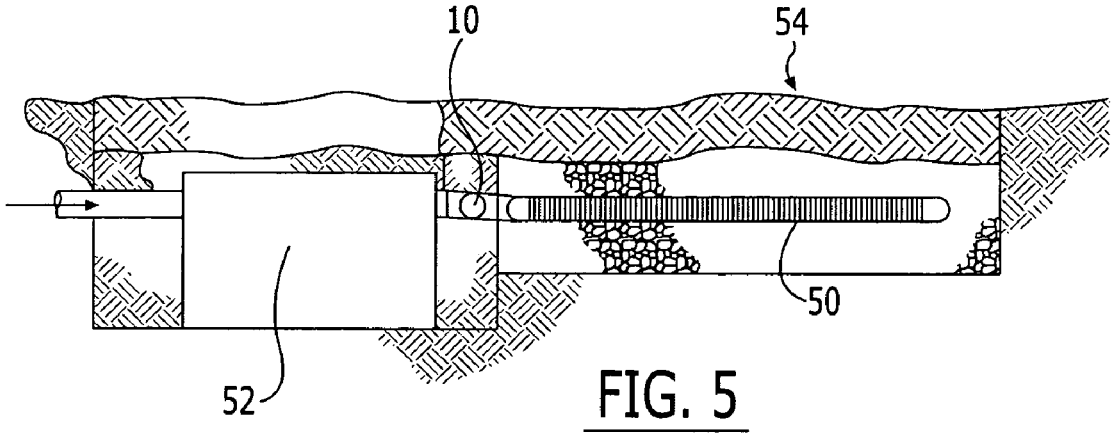
FIG. 5 is a partial side cut-away elevation view of a septic tank and drain field system operable with the manifold embodiment of FIG. 1.
Figure 6:
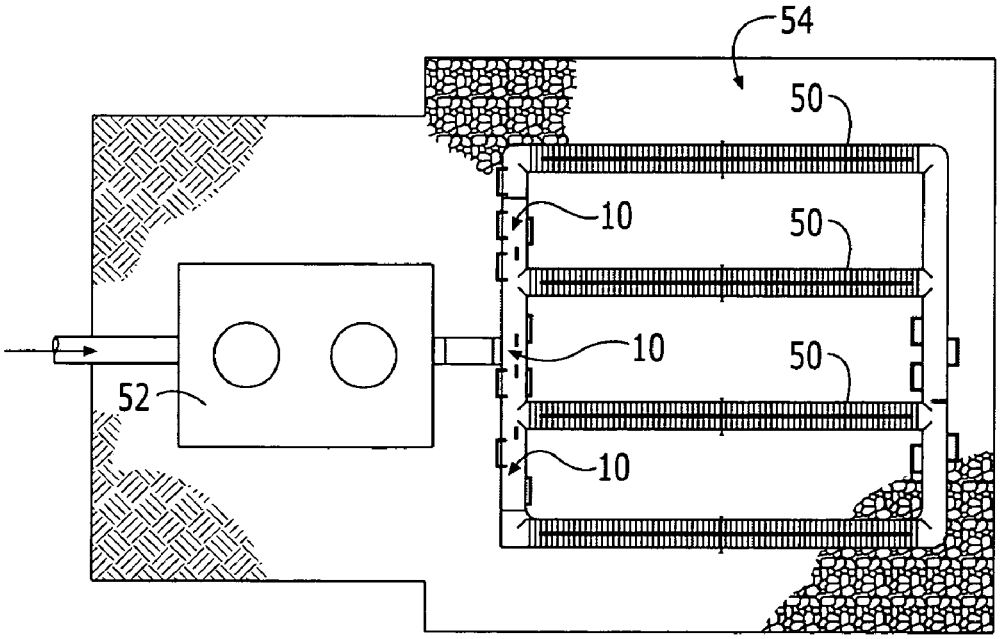
FIG. 6 is a partial top plan view of the system of FIG. 5.

As illustrated with reference to FIGS. 5 and 6, the manifold 10 may use the first and second longitudinal ports 14, 16 as inlet and outlet ports for connection to each other as cooperating manifolds with the multiple transverse ports used for connecting to drain field effluent distribution pipe 50 and a septic tank 52 in a drain filed system 54.

With reference again to FIGS. 2 and 3, the manifold 10 as herein described has a top plan view being a mirror image of its bottom plan view. Further, reference to septic distribution port and drain field distribution ports are provided for description only and in fact may be connected as desired to either the septic tank or drain field pipe as will herein later be described in greater detail. By way of example only, the transverse ports 32, 34, 36 herein described have peripheral flanges providing a female connection to flexible drain field pipe typically used and known in the art. The first and second longitudinal ports 14, 16 are herein described by way of example to have alternate female and male connection for connection to the drain field pipe element or to cooperating connected manifolds as above described. Further, and as illustrated again with reference to FIG. 1 by way of example, locking tabs are provided within the walls of the distribution ports including locking tabs 58 for attaching to corrugated pipe inserted therein as do the inlet and outlet connection ports herein described. It is expected that various connection styles will come to the mind of the reader and those skilled in the art for using manifold configurations so desired.

With reference again to FIG. 3, by installing the manifold 10 or multiple manifolds as earlier described in a level position, effluent 60 from the septic tank is retained within the effluent retention areas proximate each of the distribution ports. In addition, retaining effluent within the manifold as herein described minimizes effluent surging into the distribution field, and provides an improved gravity dosing of the effluent by volume. Typically, equal dosing requires pumping of effluent. Such an arrangement allows for a uniform distribution into the drain field pipe 50 connected to the transverse ports 30, 34, 36 during typical operation of a septic tank drain field system 54 using corrugated pipe for holding effluent therein and distributing the effluent through holes located along pipe section side portions as described in FIGS. 5 and 6 and in U.S. Pat. No. 6,120,209 by way of example. The use of the manifold 10 and multiple manifolds connected for providing the manifold described earlier with reference to FIGS. 5 and 6 allow for the use of the corrugated pipe and provide the desired assurance that effluent will be retained and distributed uniformly throughout a drain field.

Figure 7:
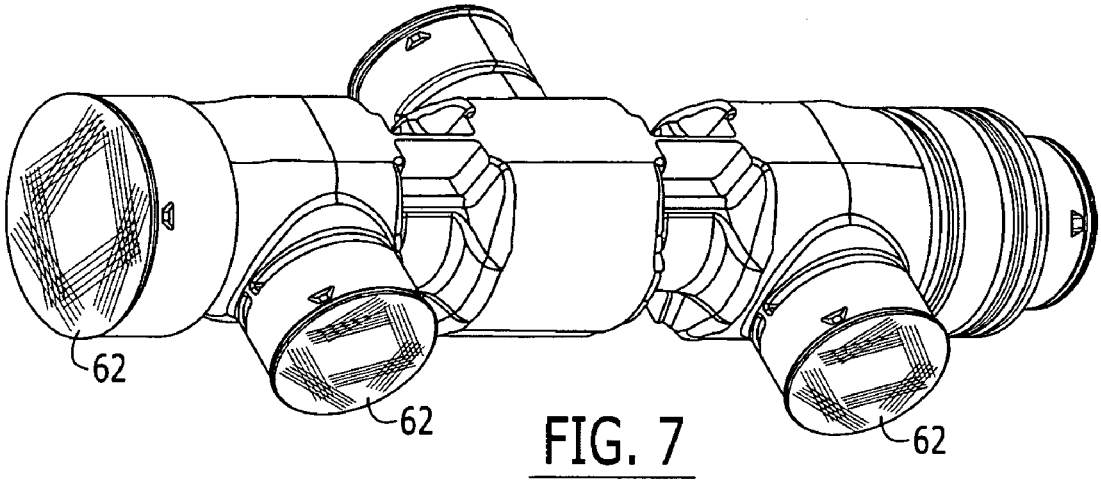
FIG. 7 is a second embodiment of FIG. 1 including closed distribution and connection ports, wherein selected ports are cut open for operation in a desired drain field distribution.
Figure 8:
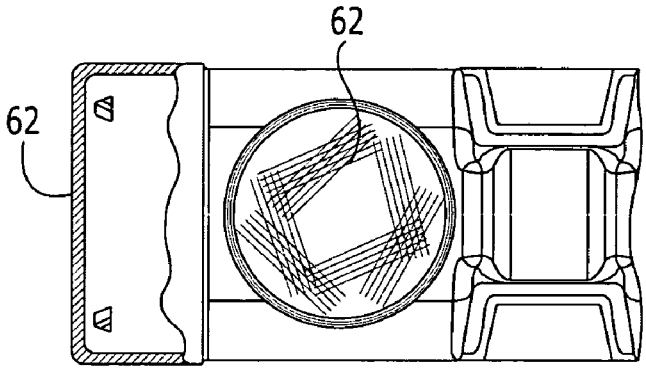
FIG. 8 is a partial cross-section view of the embodiment of FIG. 7 further illustrating the closed ports.

In order to accommodate variations in use of the manifold 10 for connecting multiple manifolds together to form a desired manifold pipe, an embodiment of the manifold device is formed having closed ports or end portions 62 for all ports including the transverse distribution ports and the inlet and outlet ports as illustrated by way of example with reference to FIGS. 7 and 8. As a result, the manifold 10 may be used in combinations the permit a desired distribution of drain field pipe as earlier described with reference to FIGS. 5 and 6, or as desired as illustrated by way of further example with reference to the tank 52, manifolds 10, and pipe 50 of FIG. 9.

Figure 10:
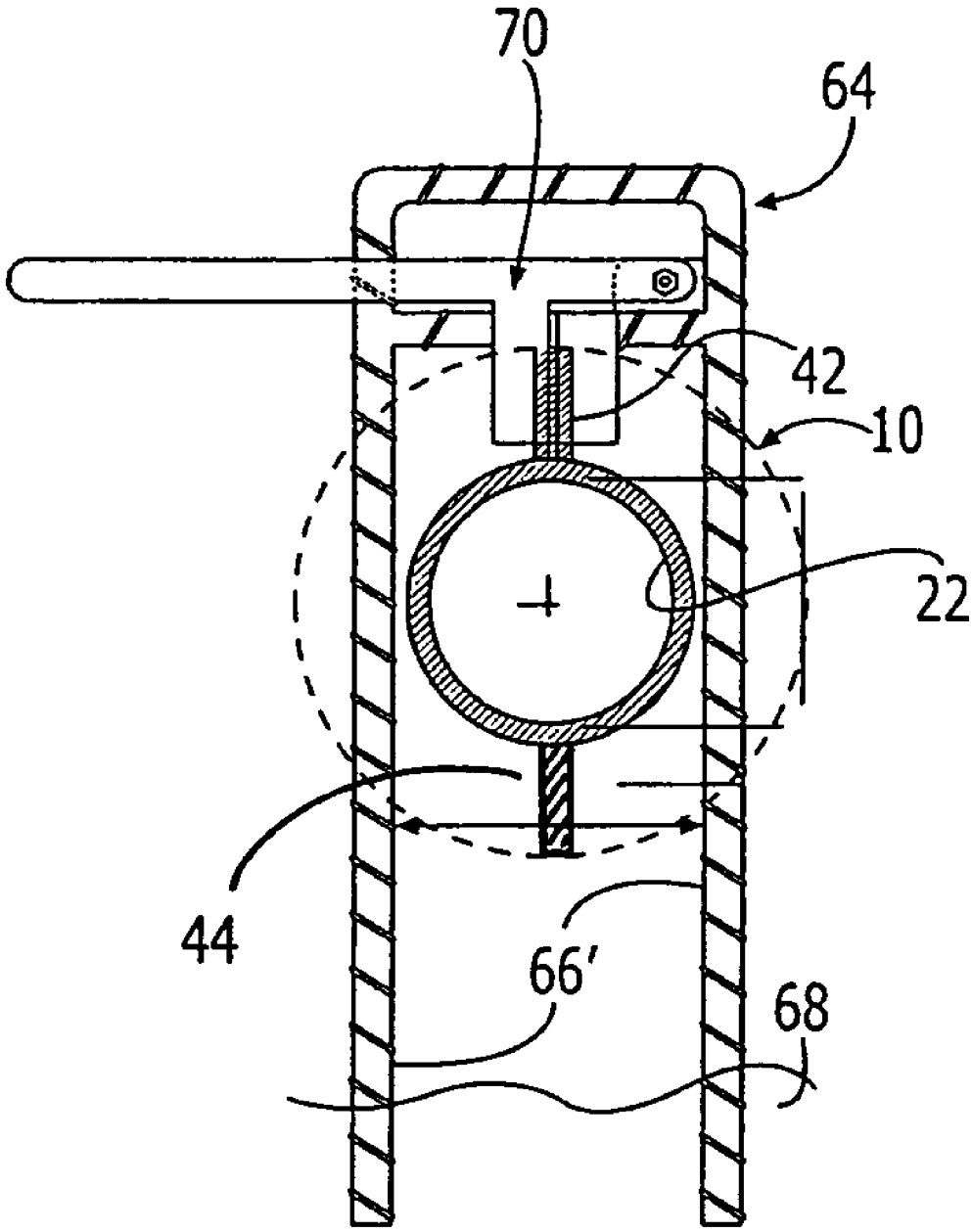
FIG. 10 is a partial elevation view illustrating use of a pipe installation clamp for securing a manifold prior to filling the drain field with gravel.

As described in U.S. Pat. No. 6,120,209 to Evens, drain field pipe having a rib radially extending from its wall may be supported by a clamping device 64 illustrated by way of example with reference to FIG. 10 that includes a pair of elongated anchor members 66 generally parallel to each other and separated for receiving the drain field pipe therebetween and suspending the pipe from its rib which extends radially outward along its longitudinal axis. The elongated anchor members 66 penetrate a grade surface of the ground 68 for holding the anchor-members upright while securing the pipe rib within the clamp above the grade surface at a desired level and orientation. A clamp 70 is attached to the anchor members 66 upper portion and holds the rib between clamp jaws. Installing drain field pipe by supporting the pipe from the radially extending rib permits the pipe to be held at the desired positions for introduction of aggregate into an absorption area containing the drain field pipe without displacing the connected pipe from the desired location. With the rib positioned upward and away from the drain field surface, the support devices holding the pipe are removed after the aggregate is placed within the drain field and around the pipe without displacing the pipe.

By way of example and with reference again to FIGS. 1 and 10, the ribs 42–48 within the manifold 10 are above the conduit portions 22, 28, which conduit portions are dimensioned to closely approximate the dimension of the corrugated pipe being installed within the drain field. As a result, the clamping devices 64 used to support the drain field pipe at the desired location and elevation may also be used during the installation of the drain field to support the multiple manifolds connected to each other for forming the manifold pipe and thus provide easy installation and alignment of the drain field piping system including the manifold and corrugated piping. Based on the above described embodiment and details for the manifold device, various combinations will come to the mind of those skilled in the art.

Figure 9:
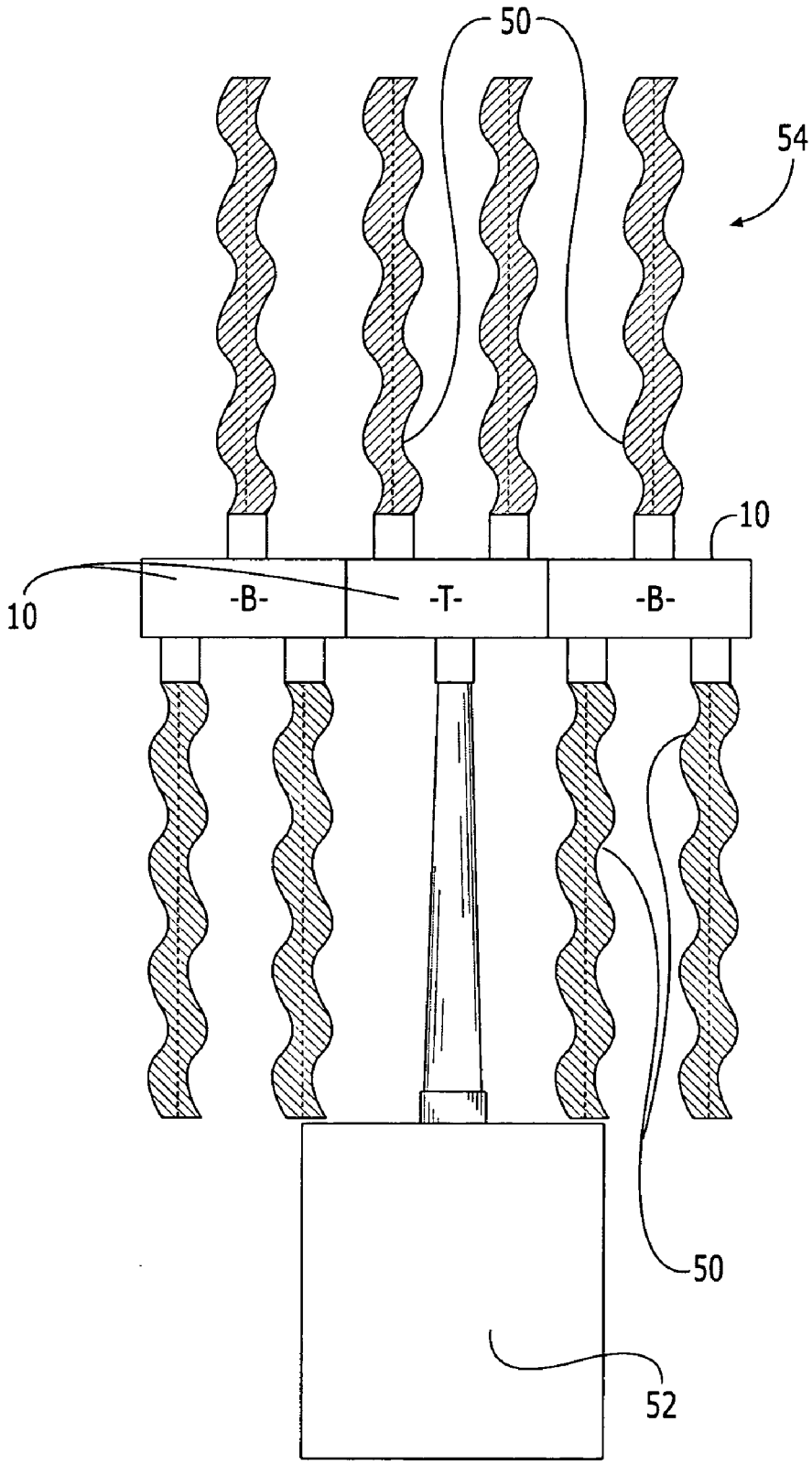
FIG. 9 is a partial plan view of one drain field system illustrating one use of the embodiments of the present invention, herein presented by way of example, wherein the drain field includes a center located manifold.
Figure 11:
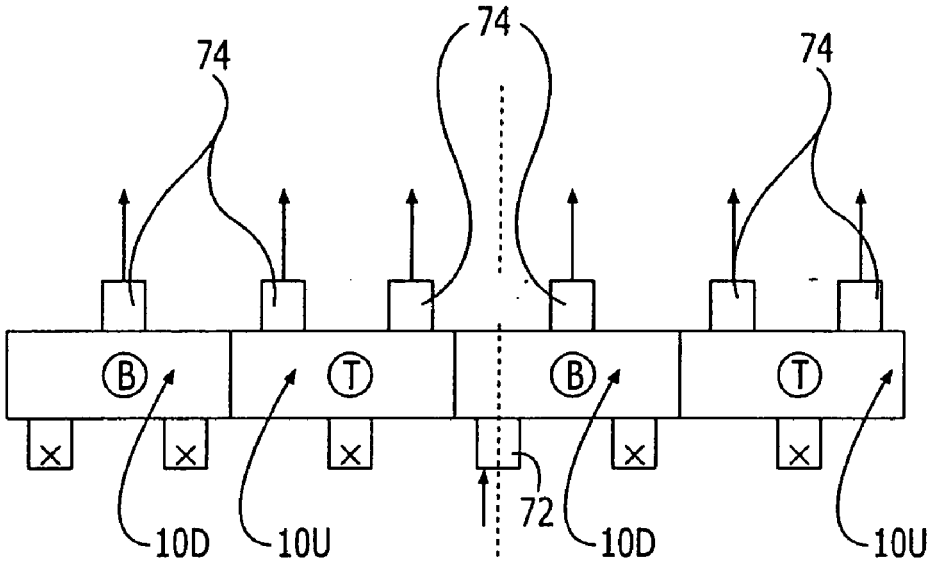
FIGS. 11 and 12 are schematic illustrations of various manifold connection combinations useful in constructing a desired drain field pipe distribution.
Figure 12:
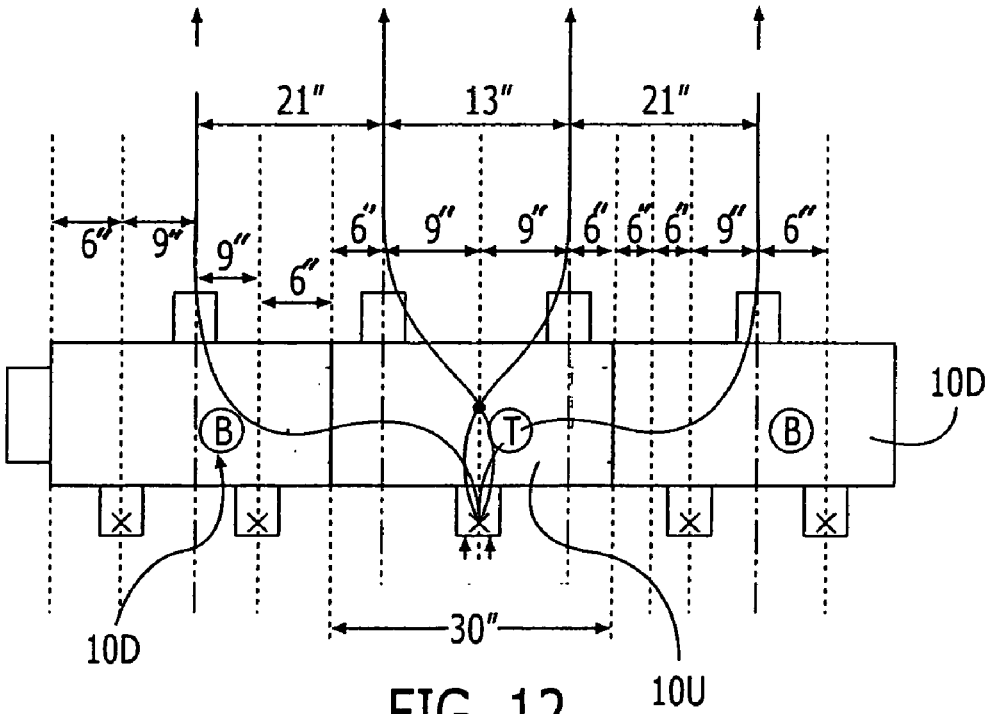

By way of example, and with reference to FIGS. 11 and 12, various combinations of the same manifold 10 positioned in an upright 10U or inverted position 10D may be connected to a similar manifold device carried in yet same or inverted position for providing a distribution scheme desirable for the user. As illustrated with reference to FIG. 11, by way of example, a single input distribution port 72 is used from the septic tank for providing effluent to four manifolds connected along their longitudinal axes while allowing six distribution ports 74 to distribute effluent to connected septic tank piping. For the example herein described with reference to FIG. 11, the distribution ports on the side of the septic tank will remain closed except for that connection to be made to the septic tank itself. Yet other possibilities will come to the mind of the reader as exampled in FIG. 12 wherein one port coming from septic tank in a center manifold device is used to provide four distribution ports to the distribution piping by having left and right manifolds inverted and connected to the center manifold device. Reference to FIGS. 9, 11, and 12 illustrate using letter designations "B" and "T" for ease of reference to a bottom view and a top view as will be appreciated with reference to FIGS. 1–3. With such an arrangement manifolds may be connected as B-T-B-T as in FIG. 11, B-T-B as in FIG. 12, or others such as T-T-B and alike as may be desired.

Yet further combinations of uses will come to the mind of the reader having had the advantage of the teachings of the present invention. By way of example, it may be desired to have the manifold pipe located within a central portion of the drain field to allow for a specific distribution of effluent from the septic tank through the centrally located manifold pipe and outwardly to the drain field pipe extending radially from the longitudinal axis of the multiple manifold devices.

That which is claimed is:

1. A manifold comprising:

an elongate tubular body having a first longitudinal port and an opposing second longitudinal port for providing fluid flow through the elongate tubular body along a longitudinal axis thereof, the elongate tubular body having at least one effluent retention portion and at least one conduit portion formed therein, wherein the at least one effluent retention portion and the at least one conduit portion extend longitudinally along the longitudinal axis, and wherein an inner cross-sectional area of the elongate tubular body for the at least one effluent retention portion is greater than the inner cross-sectional area for the at least one conduit portion such that fluid entering the elongate tubular body passes through the at least one conduit portion and is retained within the at least one effluent retention portion during use of the manifold when the longitudinal axis is generally horizontal;

a first transverse port positioned between the first and second longitudinal ports for providing a transverse fluid flow from a first effluent retention portion of the at least one effluent retention portion, the first transverse port having an axis within a plane of and generally orthogonal to the longitudinal axis;

a second transverse port positioned between the first transverse port and at least one of the first and second longitudinal ports for providing a second transverse fluid flow from a second effluent retention portion, the second transverse port having an axis within the plane of and generally orthogonal to the longitudinal axis, wherein the first and second transverse ports extend outwardly from the longitudinal axis in opposing directions; and opposing first and second ribs extending outwardly from an outside surface of the at least one conduit portion of the tubular body, wherein the first and second ribs radially extend from the longitudinal axis and are orthogonal to the plane having the transverse port axes and longitudinal axis therein, and wherein the ribs provide means for attaching to a clamping device when supporting the manifold in a desired location and elevation during an installation of the manifold.

2. A manifold according to claim 1, wherein each of the ports is closed, and wherein a cut is made in the manifold for opening a selected one of the ports for permitting fluid flow therethrough.

3. A manifold according to claim 1, wherein the first and second longitudinal ports are centered about the longitudinal axis of the elongate tubular body.

4. A manifold according to claim 1, wherein the manifold comprises a third effluent retention portion and a third transverse port, and wherein the first transverse port extends from the first effluent retention portion for directing fluid flow in a first transverse direction, and the second and third transverse ports respectively extend from the second and third effluent retention portions for directing flow into a second transverse direction, which second transverse direction radially opposes the first transverse direction.

5. A manifold according to claim 4, wherein a top plan view of the manifold comprises a mirror image of a bottom plan view of the manifold.

6. A manifold according to claim 1, wherein the first and second longitudinal ports comprise male and female connections respectively, each for connecting to a manifold having a similar form thereto.

7. A manifold according to claim 1, wherein the inner cross-sectional areas are circular.

8. A manifold comprising:

an elongate tubular body having a first longitudinal port and an opposing second longitudinal port for providing fluid flow therethrough along a longitudinal axis thereof, the elongate tubular body having at least one effluent retention portion and at least one conduit portion formed therein, wherein the at least one effluent retention portion and the at least one conduit portion extend longitudinally along the longitudinal axis, and wherein an inner cross-sectional area of the elongate tubular body for the at least one effluent retention portion is greater than the inner cross-sectional area for the at least one conduit portion such that fluid entering the elongate tubular body passes through the at least one conduit portion and is retained within the at least one effluent retention portion during use of the manifold when the longitudinal axis generally horizontal;

a first transverse port positioned between the first and second longitudinal ports for providing a transverse fluid flow from the elongate tubular body in a first transverse direction;

a second transverse port positioned between the first and second longitudinal ports for providing a second transverse fluid flow from the elongate tubular body in a second transverse direction, wherein the first and second transverse ports extend outwardly from the longitudinal axis in opposing directions; and at least one rib extending outwardly from an outside surface of the at least one conduit portion of the tubular body orthogonally to a plane having an axis of at least one transverse port and the longitudinal axis of the elongate tubular body therein.

9. A manifold according to claim 8, wherein each of the ports is closed, and wherein a cut is made in the manifold for opening a selected one of the ports for permitting fluid flow therethrough.

10. A manifold according to claim 8, wherein at least one of the first and second transverse ports extends from the at least one effluent retention portion.

11. A manifold according to claim 8, wherein the at least one rib comprises opposing first and second ribs radially extending from the elongate tubular body along the longitudinal axis.

12. A manifold according to claim 8, wherein the first and second longitudinal ports are centered about the longitudinal axis of the elongate tubular body.

13. A manifold according to claim 12, wherein axes of the first and second transverse ports lie within a single plane of and are generally orthogonal to the longitudinal axis.

14. A manifold according to claim 8, wherein the at least one effluent retention portion comprises first, second, and third effluent retention portions and the manifold comprises a third transverse port, and wherein the first transverse port extends from the first effluent retention portion for directing fluid flow in the first transverse direction, and the second and third transverse ports respectively extend from the second and third effluent retention portions for directing flow into the second transverse direction, which second transverse direction radially opposes the first transverse direction.

15. A manifold according to claim 14, wherein the first transverse port is positioned between the second and third transverse ports.

16. A manifold according to claim 14, wherein the at least one rib comprises opposing first and second ribs radially extending from the elongate tubular body along the longitudinal axis.

17. A manifold according to claim 16, wherein a top plan view of the manifold comprises a mirror image of a bottom plan view of the manifold.

18. A manifold according to claim 8, wherein the first and second longitudinal ports comprise a male and a female connection respectively, each for connecting to a manifold having a similar form thereto.

19. A manifold according to claim 8, further comprising a septic tank pipe connected to the first transverse port and a drain field pipe connected to the second transverse port for providing fluid flow therebetween.

20. A manifold according to claim 8, wherein the inner cross-sectional areas are circular.

21. A manifold comprising:

an elongate tubular body having a first longitudinal port and an opposing second longitudinal port for providing fluid flow through the body along a longitudinal axis thereof, the elongate tubular body having at least one effluent retention portion and at least one conduit portion formed therein, wherein the at least one effluent retention portion and the at least one conduit portion extend longitudinally alone the longitudinal axis, and wherein an inner cross-sectional area of the elongate tubular body for the at least one effluent retention portion is greater than the inner cross-sectional area for the at least one conduit portion such that fluid entering the elongate tubular body passes through the at least one conduit portion and is retained within the at least one effluent retention portion during use of the manifold when the longitudinal axis is generally horizontal;

a first transverse port positioned between the first and second longitudinal ports for providing a transverse fluid flow from a first effluent retention portion of the at least one effluent retention portion, the first transverse port having an axis within a plane of and generally orthogonal to the longitudinal axis; and a second transverse port positioned between the first transverse port and at least one of the first and second longitudinal ports for providing a second transverse fluid flow from a second effluent retention portion of the at least one effluent retention portion, the second transverse port having an axis within the plane of and generally orthogonal to the longitudinal axis, wherein the first and second transverse ports extend outwardly from the longitudinal axis in opposing directions.

22. A manifold according to claim 21, further comprising opposing first and second ribs extending outwardly from an outside surface of the at least one conduit portion of the tubular body.

23. A manifold according to claim 21, wherein each of the ports is closed, and wherein a cut is made in the manifold for opening a selected one of the ports for permitting fluid flow therethrough.

24. A manifold according to claim 21, wherein the first and second longitudinal ports are centered about the longitudinal axis of the elongate tubular body.

25. A manifold according to claim 21, wherein the manifold comprises a third effluent retention portion and a third transverse port, and wherein the first transverse port extends from the first effluent retention portion for directing fluid flow in a first transverse direction, and the second and third transverse ports respectively extend from the second and third effluent retention portions for directing flow into a second transverse direction, which second transverse direction radially opposes the first transverse direction.

26. A manifold according to claim 25, wherein a top plan view of the manifold comprises a mirror image of a bottom plan view of the manifold.

27. A manifold according to claim 21, wherein the first and second longitudinal ports comprise male and female connections respectively, each for connecting to a manifold having a similar form thereto.

28. A manifold according to claim 21, wherein the inner cross-sectional areas are circular.

* * * * *